US010752475B2

(12) United States Patent
Liu et al.

(10) Patent No.: US 10,752,475 B2
(45) Date of Patent: Aug. 25, 2020

(54) CHUCK DISASSEMBLY AND TRANSFER DEVICE

(71) Applicant: CITIC Dicastal CO., LTD., Qinhuangdao, Hebei (CN)

(72) Inventors: Weidong Liu, Qinhuangdao (CN); Fengyan Liu, Qinhuangdao (CN); Jiandong Guo, Qinhuangdao (CN); Yongwang Zhao, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 670 days.

(21) Appl. No.: 15/609,705

(22) Filed: May 31, 2017

(65) Prior Publication Data

US 2018/0201485 A1 Jul. 19, 2018

(30) Foreign Application Priority Data

Jan. 18, 2017 (CN) ..... 2017 1 0036040

(51) Int. Cl.
*B66C 23/48* (2006.01)
*B66C 23/04* (2006.01)
*B66C 1/44* (2006.01)

(52) U.S. Cl.
CPC ..... *B66C 23/48* (2013.01); *B66C 1/447* (2013.01); *B66C 23/04* (2013.01)

(58) Field of Classification Search
CPC ..... B66F 7/00; B24B 5/44; B24B 9/04; B66C 23/48; B66C 23/04; B66C 1/447; B66C 19/007; B23Q 1/01; B23Q 1/015; B23Q 1/25; B23Q 1/262; B23Q 1/40; B23Q 1/56; B23Q 1/60; B23Q 1/603; B23Q 1/606; B23Q 1/621
(Continued)

(56) References Cited

U.S. PATENT DOCUMENTS 2,419,813 A * 4/1947 Berchtold ..... B66C 23/48 187/244
4,090,625 A * 5/1978 Walters ..... B66C 23/48 414/743
(Continued)

FOREIGN PATENT DOCUMENTS

CN 201825695 U 5/2011
CN 202808272 U 3/2013
(Continued)

*Primary Examiner* — Orlando E Aviles
*Assistant Examiner* — Seahee Hong
(74) *Attorney, Agent, or Firm* — Cooper Legal Group, LLC

(57) ABSTRACT

Disclosed is a chuck disassembly and transfer device, which is composed of a telescopic cylinder, a cylinder support, a second linear guide rail, a second guide rail sliding seat, a lifting support, a chuck, a lifting chain, a lifting cylinder and the like, wherein the cylinder support and the second linear guide rail are fixed on the frame, the lifting support is connected with the second linear guide rail via the second guide rail sliding seat, and the telescopic cylinder is capable of driving the lifting support and the chuck to move horizontally along the second linear guide rail; the lifting cylinder is fixed on the lifting support, the chuck is connected with an output shaft of the lifting cylinder via the lifting chain, and the lifting cylinder is capable of driving the chuck to move vertically.

1 Claim, 1 Drawing Sheet

(58) Field of Classification Search
USPC ..... 254/4 R, 4 B, 4 C, 45, 47, 93 R, 134, 254/10 C, 10 R, 8 R; 269/55
See application file for complete search history.

(56) References Cited

U.S. PATENT DOCUMENTS 4,523,684 A * 6/1985 Baisden ..... B66C 23/04 212/175
4,867,321 A * 9/1989 Montgon ..... B66C 23/72 212/196
5,114,295 A * 5/1992 Jansson ..... B66C 19/007 212/326
5,188,247 A * 2/1993 Jastrow ..... B66C 23/48 212/257
6,732,871 B1 * 5/2004 Flores ..... B66C 23/48 212/180
7,121,745 B2 * 10/2006 Chapman ..... B66F 11/048 396/428
7,992,733 B2 * 8/2011 Laliberte ..... B66C 1/445 212/197
8,991,626 B2 * 3/2015 Crain ..... B66C 23/42 212/295
9,321,614 B2 * 4/2016 Moran ..... B66C 13/063
10,071,887 B2 * 9/2018 Hudgens ..... B66C 9/00
10,077,170 B2 * 9/2018 Schwabenthan ..... B66C 23/48
10,364,133 B1 * 7/2019 Chen ..... B66C 23/78
2002/0166490 A1 * 11/2002 Kapsner ..... B66C 1/447 114/44
2014/0360961 A1 * 12/2014 Steffes ..... F16L 27/087 212/251

FOREIGN PATENT DOCUMENTS

| | | | |
|---|---|---|---|
| CN | 103862026 | A | 6/2014 |
| CN | 203726485 | U | 7/2014 |
| CN | 204007398 | U | 12/2014 |
| CN | 105384115 | A | 3/2016 |
| CN | 206375631 | U | 8/2017 |
| EP | 0203141 | A1 | 12/1986 |
| JP | H10194674 | A | 7/1998 |
| WO | 8603186 | A1 | 6/1986 |

* cited by examiner

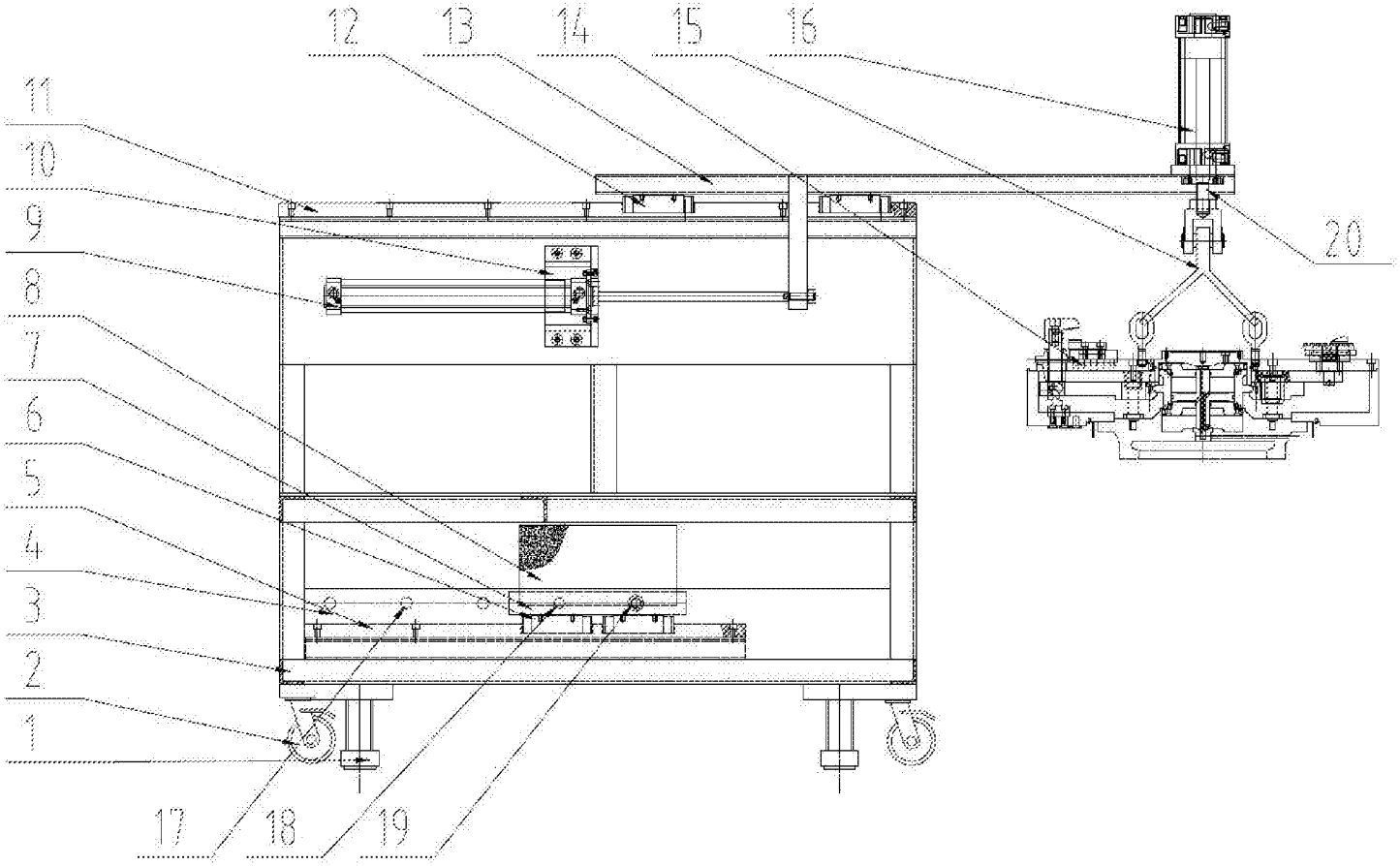
20
16
15
14
13
12
11
10
9
8
7
6
5
4
3
2
1
17
18
19

CHUCK DISASSEMBLY AND TRANSFER DEVICE

CROSS-REFERENCE TO RELATED APPLICATIONS

This application is filed based upon and claims priority to Chinese Patent Application No. 201710036040.5, filed on Jan. 8, 2017, the entire contents of which are incorporated herein by reference.

TECHNICAL FIELD

The disclosure relates to a chuck replacing device, and specifically to a device for disassembling and transferring a lathe chuck in a wheel machining process.

BACKGROUND

In the production industry of automobile wheels, due to the multiformity of dimensions and structures of wheels, chucks often need to be replaced when the wheel type is replaced. In consideration of the situation that the internal space of a workshop site unit is small and the limitation of the internal spatial structure of a vertical lathe, a common tool such as a crown block or a forklift or the like cannot meet the requirements of chuck disassembly and transfer. A chuck in a machining workshop is often manually disassembled and transferred by a plurality of persons with the help of simple tools when being replaced, and this method is not only laborious and time-consuming, but also has great potential safety hazards.

SUMMARY

The object of the disclosure is to provide a chuck disassembly and transfer device.

In order to achieve the above object, the disclosure adopts the technical solution: a chuck disassembly and transfer device is composed of adjustable supporting legs, universal rollers, a frame, a guard plate, a first linear guide rail, a first guide rail sliding seat, a mounting plate, a balance weight, a telescopic cylinder, a cylinder support, a second linear guide rail, a second guide rail sliding seat, a lifting support, a chuck, a lifting chain and a lifting cylinder.

The universal rollers and the adjustable supporting legs are installed on the frame. When the device is used for transferring, the adjustable supporting legs are folded, and the universal rollers support the whole device; and when the chuck is lifted, the adjustable supporting legs are unfolded and support the whole device.

The guard plate and the first linear guide rail are fixed on the frame, the mounting plate is connected with the first linear guide rail via the first guide rail sliding seat, the balance weight is fixed on the mounting plate, the guard plate and the mounting plate are provided with a series of corresponding limiting holes and threaded holes, the balance weight is capable of moving linearly along the first linear guide rail via the first linear guide rail and the first guide rail sliding seat, and according to different weight of the chuck, bolts pass through the limiting holes of the guard plate and are screwed into the threaded holes of the mounting plate to fix the balance weight at a specified position.

The cylinder support and the second linear guide rail are fixed on the frame, the lifting support is connected with the second linear guide rail via the second guide rail sliding seat, and the telescopic cylinder is capable of driving the lifting support and the chuck to move horizontally along the second linear guide rail.

The lifting cylinder is fixed on the lifting support, the chuck is connected with an output shaft of the lifting cylinder via the lifting chain, and the lifting cylinder is capable of driving the chuck to move vertically.

In practical use, when this device needs to transfer the chuck, the adjustable supporting legs are folded, and the universal rollers support the whole device; simultaneously, the balance weight is pushed manually to move to the middle of the device along the first linear guide rail, the bolts pass through the limiting holes of the guard plate and are screwed into the threaded holes of the mounting plate to fix the balance weight at the specified position. The device can quickly and flexibly transfer the chuck.

When the chuck is disassembled, firstly, the device is moved to a specified position inside a unit, the adjustable supporting legs are unfolded and support the whole device, and the universal rollers are suspended; according to the weight of the chuck, the balance weight is pushed manually to move to the specified position of the device along the first linear guide rail, and the bolts pass through the limiting holes of the guard plate and are screwed into the threaded holes of the mounting plate to fix the balance weight at this position. The telescopic cylinder is capable of driving the lifting support and the lifting cylinder 16 to move horizontally to a position above the chuck along the second linear guide rail, the lifting chain is connected with the chuck and the lifting cylinder, the lifting cylinder lifts the chuck, then the telescopic cylinder drives the chuck to move to a position above the device, and the lifting cylinder places the chuck onto the device. So far, the disassembly of the chuck is completed.

The chuck disassembly and transfer device of the disclosure can meet the requirements of chuck disassembly and transfer in use, and has the characteristics of simple structure, working reliability, high precision and the like.

BRIEF DESCRIPTION OF THE DRAWINGS

FIG. 1 is a structural schematic diagram of a chuck disassembly and transfer device of the disclosure.

LIST OF REFERENCE SYMBOLS

1 adjustable supporting leg
2 universal roller
3 frame
4 guard plate
5 first linear guide rail
6 first guide rail sliding seat
7 mounting plate
8 balance weight
9 telescopic cylinder
10 cylinder support
11 second linear guide rail
12 second guide rail sliding seat
13 lifting support
14 chuck
15 lifting chain
16 lifting cylinder
17 limiting hole
18 threaded hole
19 bolt
20 output shaft

DETAILED DESCRIPTION

Details and working conditions of a specific device provided by the disclosure will be described in detail below in combination with the accompanying drawing.

A chuck disassembly and transfer device of the disclosure is composed of adjustable supporting legs 1, universal rollers 2, a frame 3, a guard plate 4, a first linear guide rail 5, a first guide rail sliding seat 6, a mounting plate 7, a balance weight 8, a telescopic cylinder 9, a cylinder support 10, a second linear guide rail 11, a second guide rail sliding seat 12, a lifting support 13, a chuck 14, a lifting chain 15 and a lifting cylinder 16.

The universal rollers 2 and the adjustable supporting legs 1 are installed on the frame 3. When the device is used for transferring, the adjustable supporting legs 1 are folded, and the universal rollers 2 support the whole device; and when the chuck is lifted, the adjustable supporting legs 1 are unfolded and support the whole device.

The guard plate 4 and the first linear guide rail 5 are fixed on the frame 3, the mounting plate 7 is connected with the first linear guide rail 5 via the first guide rail sliding seat 6, the balance weight 8 is fixed on the mounting plate 7, the guard plate 4 and the mounting plate 7 are provided with a series of corresponding limiting holes 17 and threaded holes 18, the balance weight 8 is capable of moving linearly along the first linear guide rail 5 via the first linear guide rail 5 and the first guide rail sliding seat 6, and according to different weight of the chuck, bolts 19 pass through the limiting holes 17 of the guard plate 4 and are screwed into the threaded holes 18 of the mounting plate 7 to fix the balance weight at a specified position.

The cylinder support 10 and the second linear guide rail 11 are fixed on the frame 3, the lifting support 13 is connected with the second linear guide rail 11 via the second guide rail sliding seat 12, and the telescopic cylinder 9 is capable of driving the lifting support 13 and the chuck 14 to move horizontally along the second linear guide rail 11.

The lifting cylinder 16 is fixed on the lifting support 13, the chuck 14 is connected with an output shaft 20 of the lifting cylinder 16 via the lifting chain 15, and the lifting cylinder 16 is capable of driving the chuck 14 to move vertically.

In practical use, when this device needs to transfer the chuck, the adjustable supporting legs 1 are folded, and the universal rollers 2 support the whole device; simultaneously, the balance weight 8 is pushed manually to move to the middle of the device along the first linear guide rail 5, the bolts 19 pass through the limiting holes 17 of the guard plate 4 and are screwed into the threaded holes 18 of the mounting plate 7 to fix the balance weight 8 at the specified position. The device can quickly and flexibly transfer the chuck 14.

When the chuck is disassembled, firstly, the device is moved to a specified position inside a unit, the adjustable supporting legs 1 are unfolded and support the whole device, and the universal rollers 2 are suspended; according to the weight of the chuck 14, the balance weight 8 is pushed manually to move to the specified position of the device along the first linear guide rail 5, and the bolts 19 pass through the limiting holes 17 of the guard plate 4 and are screwed into the threaded holes 18 of the mounting plate 7 to fix the balance weight 8 at this position. The telescopic cylinder 9 can drive the lifting support 13 and the lifting cylinder 16 to move horizontally to a position above the chuck 14 along the second linear guide rail 11, the lifting chain 15 is connected with the chuck 14 and the lifting cylinder 16, the lifting cylinder 16 lifts the chuck 14, then the telescopic cylinder 9 drives the chuck 14 to move to a position above the device, and the lifting cylinder 16 places the chuck 14 onto the device. So far, the disassembly of the chuck 14 is completed.

What is claimed is:

1. A chuck disassembly and transfer device, comprising: adjustable supporting legs, universal rollers, a frame, a guard plate, a first linear guide rail, a first guide rail sliding seat, a mounting plate, a balance weight, a telescopic cylinder, a cylinder support, a second linear guide rail, a second guide rail sliding seat, a lifting support, a chuck, a lifting chain and a lifting cylinder, wherein the universal rollers and the adjustable supporting legs are installed on the frame; the guard plate and the first linear guide rail being fixed on the frame, the mounting plate being connected with the first linear guide rail via the first guide rail sliding seat, the balance weight being fixed on the mounting plate, the guard plate and the mounting plate being provided with a series of corresponding limiting holes and threaded holes, the balance weight being capable of moving linearly along the first linear guide rail via the first linear guide rail and the first guide rail sliding seat, and bolts passing through the limiting holes of the guard plate and being screwed into the threaded holes of the mounting plate to fix the balance weight at a specified position; the cylinder support and the second linear guide rail being fixed on the frame, the lifting support being connected with the second linear guide rail via the second guide rail sliding seat, and the telescopic cylinder being capable of driving the lifting support and the chuck to move horizontally along the second linear guide rail; the lifting cylinder being fixed on the lifting support, the chuck being connected with an output shaft of the lifting cylinder via the lifting chain, and the lifting cylinder being capable of driving the chuck to move vertically.

* * * * *